United States Patent [19]

Chen

[11] Patent Number: 4,843,940

[45] Date of Patent: Jul. 4, 1989

[54] TONE AMPLIFICATION IN STRINGED INSTRUMENTS

[76] Inventor: Shin H. Chen, 1725 N. LeClaire, Chicago, Ill. 60639

[21] Appl. No.: 137,733

[22] Filed: Dec. 24, 1987

[51] Int. Cl.[4] ..... G10D 1/02

[52] U.S. Cl. ..... 84/277

[58] Field of Search ..... 84/274–277

[56] References Cited

U.S. PATENT DOCUMENTS 360,317 3/1887 Loppentien ..... 84/275

1,408,707 3/1922 Mc Grath ..... 84/277

*Primary Examiner*—Lawrence R. Franklin

*Attorney, Agent, or Firm*—Hill, Van Santen, Steadman & Simpson

[57] ABSTRACT

For acoustic stringed instruments of the kind having a back plate and a front plate with a resonating chamber therebetween, and a string bridge on the belly across which strings of the instrument are stretched, a device and method for causing the back plate and the belly to vibrate oppositely and thereby amplifying sound emanating from the resonating chamber.

13 Claims, 1 Drawing Sheet

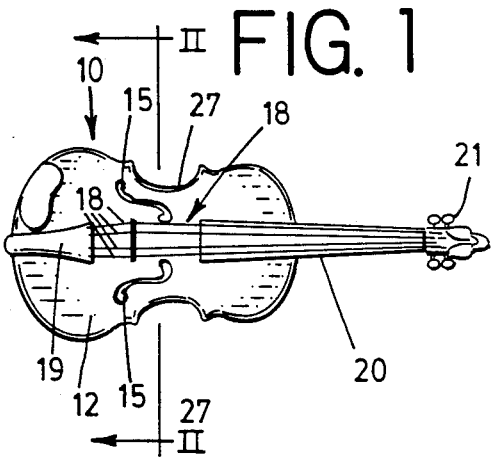
FIG. 1
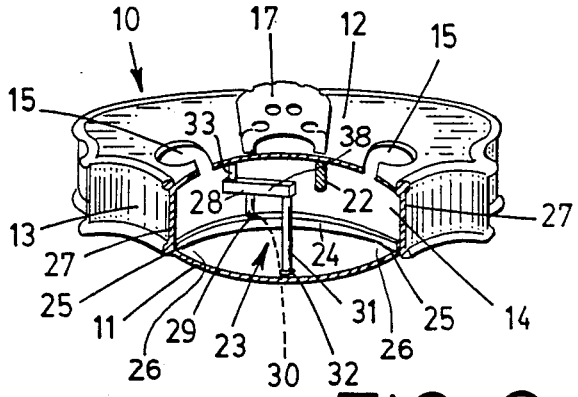
FIG. 2
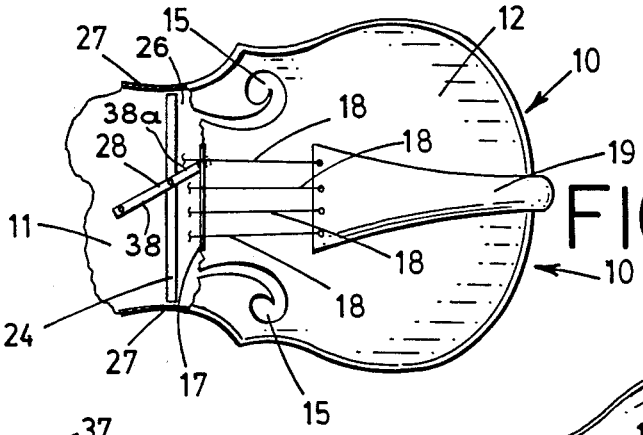
FIG. 3
FIG. 5
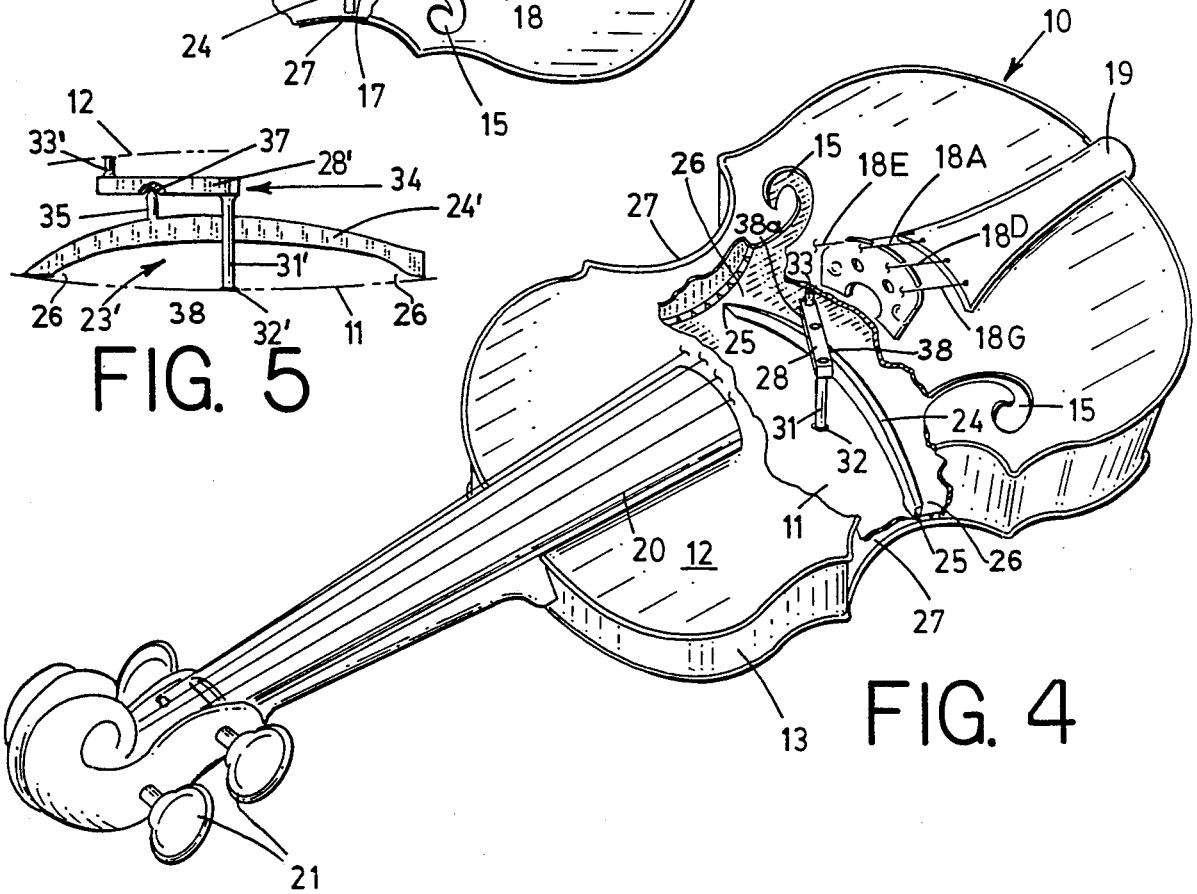
FIG. 4

TONE AMPLIFICATION IN STRINGED INSTRUMENTS

BACKGROUND OF THE INVENTION

The present invention relates to improvement in acoustic stringed instruments such as violins, guitars, and the like, wherein the hollow instrument body resonates in response to vibratory force of the strings as they are bowed or plucked. The sound holes in the top plate or belly of the sound box allow the sound to escape from the resonating instrument chamber.

Heretofore, in the case of violins, for example, the construction of the instrument sound box included a back plate that, by means of a connecting conductor post or sound post, moves in tandem or synchronously with the top plate as the latter is depressed and released (to return to the original position in each vibratory cycle of the string motion when bowed or plucked) by the bridge across which differentially gauged strings are strung and tuned to desired pitches. The attachment of the connector sound post to and between the two plates under the treble side of the bridge foot causes the tandem movement and thereby though allowing the back plate to also resonate treble sound but, due to its rigid and fixed-length nature of the post, it prevents both of the plates from moving freely or in opposite relative directions. Thus the air mass inside the sound box does not fluctuate to a significant extent.

SUMMARY OF THE PRESENT INVENTION

An important object of the present invention is to provide a method of and means for increasing tonal projection of acoustic stringed instruments by mechanically induced rapid air mass fluctuations inside the sound box.

Another object of the invention is to provide for acoustic stringed instruments a length-variable fulcrumed conductor means to allow free and relative movements of the sound plates or boards, thereby producing fuller and more even notes.

A further object of the invention is to provide a mechanical amplifier means for acoustic stringed instruments to induce the back plate to move with increased oscillation distance, thereby causing the pulsating air inside the resonating chamber to project through the sound holes in terms of improved sonic waves.

According to the principles of the present invention, there is provided an acoustic stringed instrument having a sound box comprising a back plate and a belly with a resonating chamber therebetween, and a string bridge mounted on said belly, and comprising amplifier-converter means within said chamber for causing said back plate to oscillate with substantial magnitude relative to the belly responsive to string vibratory forces transmitted through said bridge to said means, so that when the strings are bowed or plucked, the air mass inside said box is caused to fluctuate rapidly and resultant sonic pulses are projected through sound holes in said belly by the magnified back plate oscillations in terms of enhanced sonic waves.

The present invention also provides a new and improved method of amplifying acoustic stringed instrument resonating chamber sound production.

BRIEF DESCRIPTION OF THE DRAWINGS

Other objects, features and advantages of the present invention will be readily apparent from the following detailed description of representative embodiments thereof, taken in conjunction with the accompanying drawing, although variations and modifications may be effected without departing from the spirit and scope of the novel concepts embodied in the disclosure, and in which:

FIG. 1 is a plan view of an acoustic stringed instrument, in the form of a violin, although it could be a guitar, embodying features of the invention;

FIG. 2 is an enlarged cross-sectional detail view taken substantially along the line II—II in FIG. 1;

FIG. 3 is a top plan view of substantially that portion of the acoustic stringed musical instrument shown in FIG. 2;

FIG. 4 is a perspective view of the instrument of FIG. 1 with parts broken away and in section to reveal the tone amplifier-converter means in accordance with the present invention located within the sound chamber of the instrument; and FIG. 5 shows a slight modification of the sound amplifier-converter means of the present invention.

DETAILED DESCRIPTION

For illustrative purposes, the present invention is disclosed in connection with a violin 10, although the invention is also useful in connection with other hollow stringed instruments, such as guitars. Externally, the violen 10 has the usual features comprising a back plate 11 spaced below a top plate or belly 12. The back plate 11 and the belly 12 are oppositely bowed and connected in spaced relation by customary wall structure comprising ribs 13, and enclose a resonating chamber 14. The usual sound of F-holes 15 are provided in the belly 12. A bridge 17 mounted on the belly 12 in a plane transverse to the longitudinal dimension of the instrument and between the F-holes has the usual playing strings 18 stretched thereover. The strings 18 are anchored at one end to a tailpiece 19 and extend over a fingerboard 20 and are anchored at their opposite ends to pegs 21. There is, of course, also a longitudinally extending bass bar 22 on the underside of the belly 12 generally in vertical alignment with the G-string.

For enhancing sound projection, and attaining even dynamic balance of the musical notes, the back plate 11 and the belly 12 of the instrument are caused, according to the present invention, to vibrate oppositely, that is, vibrate relative to one another when the strings are bowed or plucked. This contrasts sharply in comparison to the conventional tandem movements effected by the conventional rigid conductor or sound post.

For practicing the new and improved method of the present invention, novel fulcrumed length-variable amplifier conductor means 23 are provided within the chamber 14. In one prefered construction, the assembly 23 comprises a mechanical arrangement including an upwardly arched rigid support or straddle bridge member 24 substantially parallel to the string bridge and having its opposite ends or bridge feet 25 generally aligned with the inner sides of C bout walls 27 and firmly engaged upon the margins of the back plate 11 near middle bout bottom linings 26 to provide a steady anchorage.

Extending in spaced relation over the straddle bridge 24 is a rocker bar or arm 28 connected in substantially off-center relation in a generally fulcrumed relation on the straddle bridge by means of a depending fulcrum pin 29 which extends from the arm 28 and engages the straddle bridge 24 within a socket 30. Extending downwardly from the distal end part of the substantially longer portion 38 of the arm 28 is a conductor post portion 31 which is of sufficient length to engage at its lower end upon the longitudinal central area of the back plate 11. Suitable means such as a permanent adhesive 31 fixedly secures the lower end of the post 32 to the back plate 11 so that the conductor post portion 31 will pull and move in tandem or synchronously with the back plate 11.

Projecting upwardly from the distal part of the shorter portion 38a of the arm 28 is another pin-like conductor portion 33 fixed at its lower end to the arm 28 and having its upper end in firm engagement with the belly area substantially directly under and in line with the treble side of the bridge 17 to receive strings induced vibratory force and translate it through the assembly 23 to vibrate oppositely, when the strings are bowed or plucked.

As the strings 18 of the instrument 10 are activated by being bowed or plucked the belly 12 is energized, within each vibratory cycle, a downward thrust and release movement of the belly 12 is effected. In rapid succession, at a rate depending on the pitch of the note played, the belly movements or vibrations induced by the thrust-release cycles of vibratory force from the strings 18 via the bridge 17 are transmitted downwardly through the pin portion 33 to the arm 28 which rocks about its fulcrum 29 at the point closer to member 33 and allows a wider swing for the other longer end portion 38 to amplify or magnify the back plate movement or oscillation transmitted by the post portion 31 to the center of the back plate 11 which is caused in a vibratory cycle to move upwardly in response to downward pressure of the belly 12 and then in return half of the cycle the assembly 23 releases the back plate 11 downward to the initial position. As a result of the magnified relative movements of the sound plates or boards 11 and 12 effected by the amplifier-converter means 23, rapid air mass fluctuation or sonic pulsation within the resonating chamber 14 is significantly achieved and the magnified back plate oscillation further forces, i.e. pumps, the resultant sonic (air mass) pulses through the sound holes 15 and projects the desired musical tones to a great distance. Evenness in the dynamics of the notes is achieved by virtue of the non-rigid length-variable conductor means 23 that are incorporated to allow free vibration of the soundboards without interference from a rigid sound post or from the natural frequencies of the sound boards that might conflict with those of the intended notes where a rigid post would further complicate such conflict.

Different materials such as hardwood, aluminum alloy, or graphite composite may be used for the novel transmission conductor assembly 23 including the bridge 24, the rocker bar 28, the fulcrum pin 29, and the conductor post portions 31, 33.

Where a rigid alloy is used, a coupling of an inverted V-fulcrum 35 (FIG. 5) integal with the bridge 24' and a fulcrum notch 37 in the rocker arm 28' may be substituted for the fulcrum pin 19. Other elements of the assembly 23' correspond to the assembly 23 and are indentified by primed reference numbers.

It will be understood that variations and modifications may be effected without departing from the spirit and scope of novel concepts of the present invention.

I claim as my invention:

1. An acoustic stringed instrument having a sound box comprising a back plate and a belly with a resonating chamber therebetween, and strings stretched across a string bridge mounted on said belly in a plane transverse to the longitudinal dimension of the instrument, and comprising:

amplifier-converter means within said chamber for causing said back plate to oscillate with substantial magnitude relative to the belly responsive to string vibratory forces transmitted through said bridge to said means, so that when the strings are bowed or plucked, the air mass inside said box is caused to fluctuate rapidly and resultant sonic pulses are projected through sound holes in said belly by the magnified back plate oscillations in terms of enhanced sonic waves;

said amplifier-converter means comprising a substantially rigid straddle bridge member extending across said back plate from side-to-side between the opposite sides of said chamber and substantially parallel to said string bridge, and a rocker mounted on said straddle bridge member and having opposite end elements including a member secured fixedly to substantially the center of said back plate and a member engaging said belly under said string bridge, whereby there is caused an upward pumping action of said back plate when said belly is energized by activated string action.

2. An acoustic stringed instrument according to claim 1, wherein said belly engaging member is in firm but unattached contact connection with said belly substantially under the treble side of said string bridge.

3. An acoustic stringed instrument according to claim 2, wherein one end portion of said rocker is longer than the opposite end portion.

4. An acoustic stringed instrument according to claim 1, wherein said bridge member is arched upwardly, and said rocker has a downwardly projecting fulcrum element fulcrumed on said straddle bridge member.

5. An acoustic stringed instrument according to claim 1, wherein said straddle bridge member is arched upwardly, and said straddle bridge member has an upwardly projecting fulcrum element on which said rocker is fulcrumed.

6. A mechanical amplifier-converter assembly mounted within the resonating chamber of an acoustic stringed instrument of the kind having a back plate and a belly and a string bridge on said belly across which strings of the instrument are stretched, said assembly comprising:

an arched, substantially rigid support bridging the back plate from side-to-side within the resonating chamber;

a vibration transmitter fulcrumed on said support;

a first connection on said transmitter fixedly attached to substantially the center of said back plate; and a second connection on said transmitter in nonattached, firm engagement with the belly of the instrument substantially under said string bridge, so that the transmitter will cause the back plate to vibrate opposite the vibrations of the belly.

7. An assembly according to claim 6, wherein said transmitter comprises a rocker arm, and a fulcrum projecting downwardly from said arm rockably fulcruming the arm on said support.

8. An assembly according to claim 6, wherein said support has a fulcrum element projecting upwardly therefrom, and said transmitter is fulcrumed on said fulcrum.

9. An assembly according to claim 6, wherein said first connection comprises a post portion on one end area of said arm, and said second connection comprises a post portion on an opposite end area of said arm.

10. A method of amplifying the sound from within a resonating chamber of an acoustic stringed instrument having a back plate and a belly, and a string bridge mounted in a plane transverse to the longitudinal dimension of the instrument on said belly across which playing strings are stretched, and comprising:

mounting a substantially rigid mechanical amplifier support in bridging relation across said back plate from side-to-side between opposite sides of said chamber substantially parallel to said bridge, and mounting a vibration transmitter on said support;

and responsive to string vibrations transmitted through said string bridge to said belly operating said transmitter between substantially the center of said back plate and said belly under said string bridge and thereby causing said back plate and said belly to vibrate opposite to one another so that tonal sounds produced by air volume movements within said chamber effected by said vibrations are amplified.

11. A method according to claim 10, which comprises providing said support as an upwardly arched straddle bridge member, and providing said amplifier as a rocker arm fulcrumed on said straddle bridge member.

12. A method according to claim 11, which comprises fixing a connection on one end portion of said rocker arm to the longitudinal median area of said back plate, and effecting a firm but unattached contact connection of an opposite end portion of said rocker arm with said belly substantially under the treble side of said string bridge.

13. A method according to claim 12, which comprises forming said one end portion longer than said opposite end portion.

* * * * *